US005593157A

United States Patent [19]

Koros et al.

[11] Patent Number: 5,593,157

[45] Date of Patent: Jan. 14, 1997

[54] LONG LIFE, LOW AIR PERMEABLE PRESSURIZED ARTICLES SUCH AS PLAY BALLS

[75] Inventors: William J. Koros, Austin, Tex.; I. G. Hargis, Tallmadge, Ohio; Richard A. Olson, Phoenix, Ariz.; Jason S. Harris, Austin, Tex.

[73] Assignee: GenCorp Inc., Fairlawn, Ohio

[21] Appl. No.: 438,674

[22] Filed: May 10, 1995

[51] Int. Cl.[6] ..... A63B 41/00

[52] U.S. Cl. ..... 473/606; 524/908

[58] Field of Search ..... 273/61 R, 61 B, 273/61 C, 61 D, 235 B, 218, 58 B, 58 BA, 58 J; 524/908; 156/648

[56] References Cited

U.S. PATENT DOCUMENTS

| | | | |
|---|---|---|---|
| 4,098,504 | 7/1978 | Koziol et al. | 273/61 R |
| 4,955,613 | 9/1990 | Gendreau et al. | 273/218 |
| 5,286,532 | 2/1994 | Yoshikawa et al. | 273/235 B |

FOREIGN PATENT DOCUMENTS

| | | |
|---|---|---|
| 8905164 | 5/1990 | Brazil . |
| 4224705C1 | 11/1993 | Germany . |

OTHER PUBLICATIONS

An article entitled "Improvement in Barrier Properties of Polymers via Sulfonation and Reductive Metallization," by Walles, W. E, *Barrier Polymers and Barrier Structures*; Koros, W. J. ed; American Chemical Society; Washington, D.C. 1990, chapter 14.

*Primary Examiner*—Steven B. Wong

*Attorney, Agent, or Firm*—Robert F. Rywalski; Daniel J. Hudak

[57] ABSTRACT

Low air permeable, pressurized articles such as play balls, e.g., a tennis ball, have a thin barrier layer formed on the vulcanized rubber core. The barrier layer is chemically bonded to the internal and/or external surface of the core, e.g., by the reaction of a Lewis acid, e.g., sulfur trioxide, with the core rubber. The thin barrier layer permits the tennis ball to be flexible and have good rebound life and yet extends the play life thereof before ball rebound or softness changes to undesired levels.

15 Claims, 1 Drawing Sheet

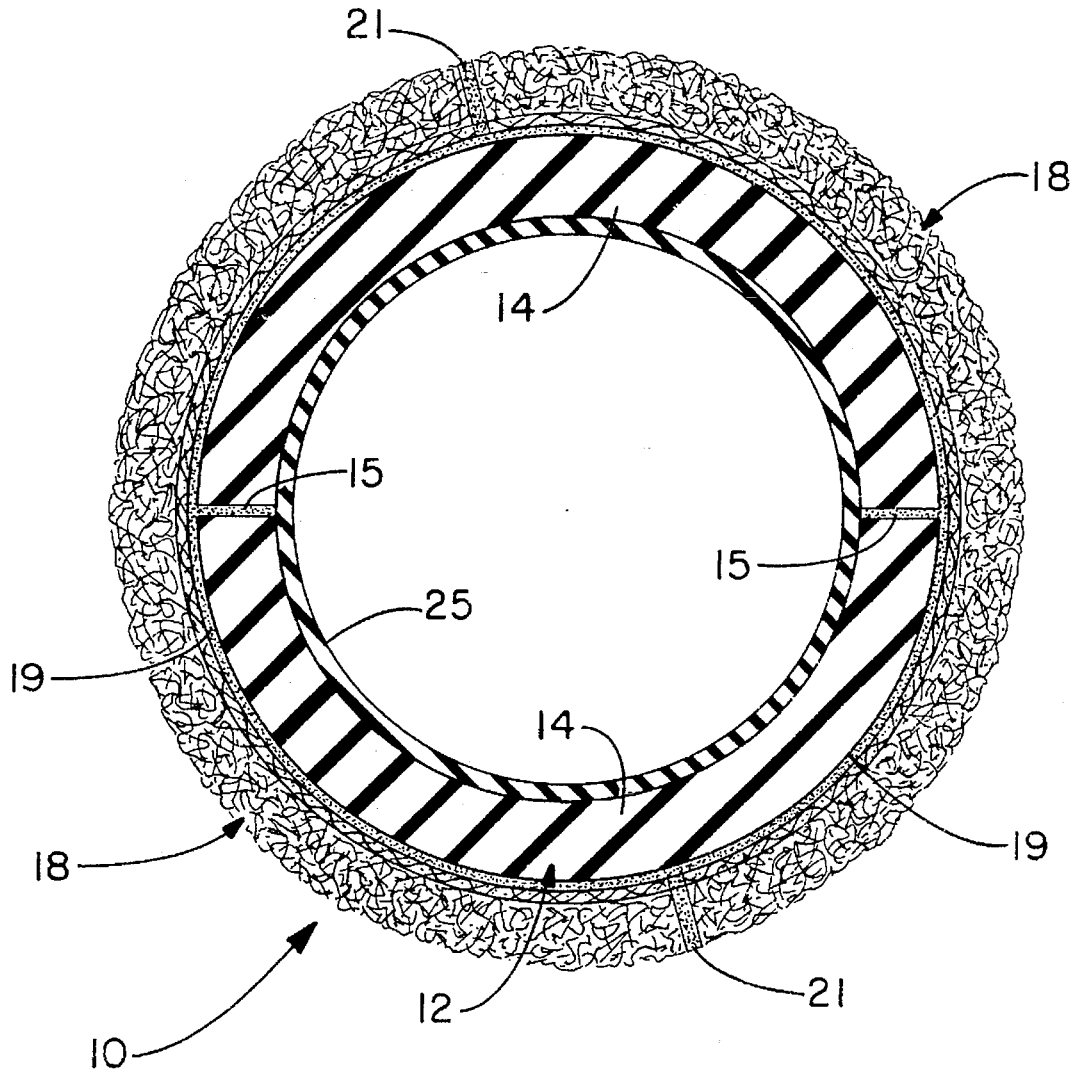
21
18
14
15
15
25
19
14
19
18
21
12
10

LONG LIFE, LOW AIR PERMEABLE PRESSURIZED ARTICLES SUCH AS PLAY BALLS

FIELD OF INVENTION

The present invention relates to pressurized articles such as play balls and especially to tennis balls having extended rebound retention or life, good retention of hardness, and good internal pressure retention. More specifically, the present invention relates to a thin barrier layer chemically bound to the internal and/or external surface of a vulcanized tennis ball core.

BACKGROUND OF THE INVENTION

An inherent problem with pressurized tennis balls is their loss of internal pressure after being removed from pressurized storage containers. Once exposed to the pressure of the earth's atmosphere, the internal pressure drops due to the diffusion of air through the wall of the tennis ball center, i.e., the core. When the pressure drops from the initial approximately 15 psi to about 10 psi and/or when the rebound thereof drops from the original approximately 55 percent rebound to less than 53 percent, changes take place in the play of the ball which are undesirable and often unacceptable.

Heretofore, long life pressurized tennis balls used coatings or films applied to the surface as a barrier layer for the core, substituted special low permeable rubbers for the accepted natural rubber cores, or contained special additives in the rubber core. Another method was to use special gasses in the core which permeated through the tennis ball cores more slowly than air.

Generally, none of these approaches have been commercially effective. For example, poly(vinylidene chloride) has been utilized as a barrier layer, but upon being struck by a racquet, the barrier layer would rupture and diffusion of air would take place more rapidly. Substituted rubber core materials included butyl rubber. However, the relatively thick walls required to effectively reduce air permeation adversely affected the rebound of tennis balls to unacceptable levels. Special low permeable gasses such as mixtures of air with $SF_6$ and $CF_4$ while producing a long life tennis ball are characterized by high cost, and having an audible and undesirable "ping" when the ball is struck by a racquet.

SUMMARY OF THE INVENTION

Long life pressure retention articles such as play balls have the internal and/or external surface of their rubber core modified by the application of a strong Lewis acid such as sulfur trioxide. The acid is generally introduced onto the ball core in the form of a gas, desirably at ambient temperature, the acid chemically reacts with and bonds to the rubber surface. The net result is a thin layer containing polar groups, e.g., sulfonates, which are highly impermeable to air. The invention is particularly suitable in pressurized balls such as tennis balls which are not reinflated. Since the formed barrier layer is thin, the flexibility of the original tennis ball and its weight are essentially unaffected and rebound properties are maintained for extended periods of time, i.e., up to several months. When the barrier layer contains sulfonate groups, such groups can be neutralized, if desired, with alkali metal or ammonium ions which provide further reductions in air permeation.

BRIEF DESCRIPTION OF DRAWINGS

The figure is a cross-sectional view of a tennis ball according to the present invention wherein the various layers, e.g., core, felt, adhesion, air-impermeable, etc., have been enlarged for purposes of description.

DETAILED DESCRIPTION OF THE INVENTION

While the invention is applicable to any type of pressurized article or laminate, and especially a play ball which contains a rubber core, it will be described in detail with regard to a tennis ball. A laminate such as tennis ball 10 generally contains a spherical rubber core or substrate 12. The spherical core is generally in the form of two cured hemispheres 14 adhered to one another with adhesive 15. Typically, the hemispheres are joined together in a pressurized chamber so that the ball has an appropriate amount of pressure within the hollow portion thereof, generally about one atmosphere above atmospheric pressure. Typically, two dogbone-shaped fabric backed felt panels 18 are adhesively secured to the core by adhesive 19. The fabric can be of any conventional material, such as cotton, whereas the felt material usually is a blend of wool and nylon fibers which are needled to the fabric backing. A seam containing adhesive 21 generally exists between the two panels to laterally adhere the same to each other although the panels can directly abut one another (not shown) throughout their length to form a seamless tennis ball. The thickness of the rubber core is generally from about 0.128 inches (3.25 mm) to about 0.142 inches (3.61 mm).

The rubber core for pressurized tennis balls is desirably made from natural rubber although synthetic cis-1,4-polyisoprene can be utilized as well as blends thereof containing up to approximately 50 percent by weight of polybutadiene, typically cis-1,4-butadiene. Other core rubbers include those made from one or more conjugated diene monomers having from 4 to 10 carbon atoms, such as butadiene, hexadiene, and the like as well as copolymers made from one or more conjugated dienes with a vinyl substituted aromatic having from 8 to 12 carbon atoms such as styrene, α-methyl styrene, and the like. Any rubber which can be utilized as a bladder or core in a play ball, or other pressurized article can also be used.

The core can include suitable amounts of conventional compounding ingredients such as fillers, for example, carbon black, clays, silica, metal carbonates, barytes, thermoplastic polyolefins such as polyethylene, for example, high density polyethylene, linear high density polyethylene, ultra high density polyethylene, etc., or polypropylene, as well as various polyethylene copolymers wherein the mole percent of the comonomer or repeat unit is generally less than 10 percent, desirably less than 5 percent and preferably from about 1 to 3 percent with specific examples including polyethylene-acrylate, polyethylene-vinyl acetate, and the like; various salts such as the zinc acrylates having from 1 to 8 carbon atoms in the ester portions; various salts such as the zinc acrylates having from 1 to 8 carbon atoms in the ester portions; various plasticizers such as dioctyl phthalate, and the like; various coupling agents; various pigments such as titanium dioxide, calcium carbonate, and the like; various metal oxides such as zinc oxide; various accelerators; as well as sulfur or peroxide based curative systems. The fabric panels can be made of materials such as a cotton or polyester fabric and a needled felt overlay which often is a blend of wool and nylon. Equivalent materials can also be used.

A laminate containing a low permeable (i.e., substantially impermeable), air barrier layer 25 is formed by treating preferably the internal surface of the tennis ball core with a strong Lewis acid either in liquid form such as $SO_3$ dissolved in methylene chloride or preferably in the form of a gas, such as chlorine, fluorine, bromine, chlorosulfuric acid, sulfur trioxide, mixtures thereof, as well as mixtures of sulfur trioxide with sulfuric acid, and the like. Due to its high reactivity and formation of large polar groups, sulfur trioxide is preferred. The Lewis acid reacts with the surface of the rubber core and actually penetrates the same to a slight depth thereof to form a thin air impermeable layer, i.e., a pressure retention layer. It is believed that when sulfur trioxide is used, a sulfonation reaction occurs whereby $SO_3H$ groups are attached to a carbon atom of the rubber polymer. The impermeability of the thin layer will depend upon various factors such as the concentration of the Lewis acid applied, the length of application, or the thickness or weight of the barrier layer, and the like.

The barrier layer formed from sulfur trioxide can be neutralized to further improve the air impermeability thereof. Suitable neutralizing agents include various metals, particularly the various alkali metals such as lithium, sodium, potassium, etc., i.e., group 1A of the Periodic Table, or various alkaline earth metals such as magnesium and calcium, i.e., group 2A of the Periodic Table. Sodium and lithium are preferred neutralizing metals. Other neutralizing agents include various ammonium salts, e.g., ammonium hydroxide, ammonium chloride, and the like. Quaternary ammonium salts also have been found to impart better barrier properties.

Although the above description including the drawing generally relates to the application of a thin barrier layer to the internal surface of a tennis ball core, the barrier layer can be applied to the exterior surface of the tennis ball, or to both the interior and exterior surfaces thereof. Moreover, while sulfur trioxide is the preferred strong Lewis acid, other acids and mixtures thereof can also be utilized and if both the internal and external surfaces are treated, the acid need not be the same.

Inasmuch as low permeability (i.e., high impermeability) is desired, permeability values as low as possible are preferred so that the play characteristics such as rebound retention, pressure retention, and the like are not adversely affected. Generally, the treated tennis ball cores of the present invention having a thin barrier layer thereon have an overall air permeability value of from about 0.95 to about 7, desirably from about 1.1 to about 5, and preferably from about 1.2 to about 3.0 barrers. A desired oxygen permeability value of the treated natural rubber core is generally from about 1.9 to about 15, desirably less than 12 or 9, and preferably less than 6 or 3 barrers. The values with respect to nitrogen are generally from about 0.7 to about 5, desirably less than 4 or less than 3, and preferably less than 2 or 1 barrers. Such barrer values of the thin barrier or pressure retention layer are generally achieved when the thickness of the barrier layer is generally from about 10 (0.25 mm) to about 100 (2.5 mm), and desirably from about 50 (1.27 mm) to about 95 mils (2.41 mm). Typically, if sulfur trioxide is utilized to form the barrier layer, the weight of the coating groups is generally from about 0.05 weight percent to 1.0 weight percent based upon the total weight of the $SO_3$ treated rubber core.

The application of the Lewis acids can be accomplished by a variety of methods. The treating agent can be applied either as a liquid or preferably as a gas. If applied as a gas, it can be applied in concentrated form, i.e., a pure or substantially pure Lewis acid or diluted with other gases such as air, nitrogen, and the like. If applied as a liquid such as $SO_3$ in methylene chloride, it can be sprayed, brushed, or dipped. When the liquid Lewis acid is sulfur trioxide, due to its extreme reactivity, it can be moderated by solvents such as low boiling halogenated hydrocarbons, and paraffins. Sulfur trioxide can also be moderated by complexing with Lewis bases, for example, pyridine, tetrahydrofuran, dimethyl sulfoxide, and the like.

The Lewis acid can be applied to an individual tennis ball, or to a plurality thereof. One desired method of application involves utilizing a clam-shell type curing press in which a plurality of tennis ball hemispheres having an adhesive on the end, i.e., annulus of the hemisphere, are contained on both the upper and lower portions of the press. The press is sealed off with respect to the atmosphere and purged with an inert gas such as nitrogen to remove any moisture therefrom. Subsequently, desired concentrations of a gas such as sulfur trioxide which is substantially or completely moisture free and typically blended with substantially or completely moisture free air is supplied thereto and allowed to contact and react with the internal surface of the rubber cores to form the low permeable barrier layer. The treatment temperature is generally ambient, i.e., from about 60° F. (15° C.) to about 110° F. (43° C.), although it can be up to the cure temperature of the rubber so that it is cured. Treatment time generally is only a few minutes, for example, 1 to 3 minutes. After sufficient treatment time, the air and sulfur trioxide are stabilized at a desirable pressure, for example, 15 psi (73 kgs/sq. meter) in excess of the earth's atmosphere, that is, at approximately 29.7 psi (145 kgs/sq. meter) absolute. The mold is then closed and the two hemispheres adhered together. Once the spherical tennis ball cores have been formed, the felt cover can be applied thereto in any conventional manner.

Tennis ball cores containing a low permeable layer in accordance with the present invention have been found to have physical properties that satisfy USTA (United States Tennis Association) and ITF (International Tennis Federation) specifications, for rebound retention, deflection, weight, and size, as well as good retention of rebound and good pressure retention. For example, an average unplayed tennis ball having an original rebound of approximately 55 percent diminished to less than 53 percent rebound in approximately 5 or 6 weeks. However, the tennis balls of the present invention have a rebound of at least 53 percent rebound in an unplayed condition for at least 2 months, desirably at least 3 or 4 months, and preferably at least 5 or 6 and even 7 months. Rebound percent is the height of the rebound in inches when dropped freely from an initial height of 100 inches (2,540 mm), and is a good indication of pressure retention.

With regard to pressure retention in the of non-treated pressurized tennis balls, the pressure will drop from the initial value of approximately 15 psi (73 kgs/sq. meter) to about 10 psi gauge (49 kgs/sq meter) in 4 to 5 weeks after removal of balls from pressurized containers. Balls that are played by repeated striking will lose pressure at a greater rate than unplayed balls. However, the tennis balls of the present invention have a pressure retention of at least 10 psi (49 kgs/sq. meter) in unplayed condition for at least three months, desirably at four months, and preferably at least five or six and even seven months.

The invention will be better understood by reference to the following examples which serve to illustrate, but not to limit, the scope of the present invention.

EXAMPLES:

Natural rubber (99.99 percent by weight) was treated with sulfur trioxide dissolved in methylene chloride in the following manner:

A 0.5% by weight solution of sulfur trioxide was prepared in methylene chloride as follows: A convenient volume of methylene chloride was added to a round-bottomed flask. A nitrogen blanket was created under which the sulfonating solution was prepared. The required amount of $SO_3$ was then pipetted in and the flask was sealed. The contents of the flask were stirred for about 20 minutes. The solution changed from colorless to pale yellow.

Three identical rubber samples having a thickness of approximately 14.5 mils (0.36 mm) were placed in three separate petri dishes. The sulfonating solution was pipetted into these dishes, and timing was started. At the end of one minute, one sample was withdrawn from the dish and placed in a petri dish containing methanol. Methanol served to quench the sulfonating solution. At the end of four minutes, another sample was removed and quenched identically. The last sample was removed at the end of ten minutes. The sulfonated films were removed from the methanol, air-dried, and stored in petri dishes.

In a manner as set forth above, two additional examples were run for a time period of 10 minutes. In one example, the amount of sulfur trioxide in methylene chloride was 2.0 percent and in the remaining example, the amount was 4.0 percent by weight.

Table I sets forth the oxygen and nitrogen permeability levels with respect to weight percent of sulfur trioxide applied.

TABLE I

| Example | Wt. % $SO_3$ | Exposure Time (min.) | Permeability (Barrers) Oxygen | Nitrogen |
|---|---|---|---|---|
| 1 (control) | Untreated NR | | 18.6 | 6.6 |
| 2* | 0.5 | 1.0 | 11.2 | 3.7 |
| 3* | 0.5 | 4.0 | 11.9 | 4.1 |
| 4* | 0.5 | 10.0 | 4.6 | 1.0 |
| 5* | 2.0 | 10.0 | Film Cracked with Flexing | |
| 6* | 4.0 | 10.0 | Film Cracked with Flexing | |

*Films of runs 2–6 were unneutralized.

As apparent from the above data, the formation of a barrier layer with sulfur trioxide in accordance with the present invention yielded significant lower permeability values with respect to oxygen and nitrogen.

In another example, tennis ball hemisphere cores were treated with a gaseous feed stream of nitrogen and sulfur trioxide as follows: To ensure that only the inner surface of the hemisphere was exposed to $SO_3$ gas, the outer surface of the hemisphere and the radial lip surface was dipped in melted candle wax. The wax-coated hemispheres were then placed in a container. The container was purged with a mixture of nitrogen and $SO_3$ gas. The gas leaving the container was added to water of a water bath so that upon reaction therewith, $H_2SO_4$ was formed. The pH of the water was then measured to provide an estimate of the amount of sulfonation that occurred. Moreover, the selectivity of the hemisphere, that is, the ratio of $P_{O2}$ over $P_{n2}$ was also tested.

The flow rate, pH and exposure time are set forth in Table II:

TABLE II

Reaction Schedule for the Hemispheres and the Exposure Time

| Sample | Q (L/min) ($N_2$ flow) | pH | Exposure Time (min) |
|---|---|---|---|
| A | 4 | 3.5 | 15 |
| B | 4 | 3.5 | 15 |
| C | 1 | 3.5 | 47 |
| D | 1 | 3.5 | 47 |
| E | 2 | 3.5 | 33 |
| F | 2 | 3.5 | 33 |
| G | 1 | 3.0 | 157 |
| H | 1 | 3.0 | 157 |

Because pH is a logarithmic function, a solution of pH 3.0 has a concentration of over 3 times larger than a solution of pH 3.5. As seen in Table II, the exposure time for samples G and H was 3.3 times longer than the exposure time for samples C and D. The permeability data is set forth in Table III.

TABLE III

Permeability Data for Reacted Hemispheres

| Sample | $P_{O2}$ (barrers) | $P_{N2}$ (barrers) | Selectivity |
|---|---|---|---|
| A | 11.1 | 4.2 | 2.64 |
| B | 10.02 | 4.0 | 2.49 |
| C | 12.47 | 5.08 | 2.45 |
| D | 11.98 | 5.29 | 2.26 |
| E | 12.64 | 4.62 | 2.74 |
| F | 11.75 | 5.26 | 2.23 |
| G | 10.22 | 5.59 | 1.83 |
| H | 11.18 | 3.99 | 2.80 |

Inasmuch as the permeability of an unreacted (control) rubber sample as set forth in Table I was approximately 18.6 barrers for oxygen and approximately 6.6 barrers for nitrogen, as apparent from Table III, improved low permeation values were obtained utilizing a gaseous treatment method.

The above invention relating to the creation of an air impermeable barrier layer on a tennis ball core is generally applicable to any type of pressurized hollow rubber or rubber bladder containing article or laminate, especially play balls such as a volleyball, a football, a basketball, a tetherball, a beachball, and the like. Although such balls are generally inflated by the use of a needle valve, the usable life thereof between repressurizing can be prolonged. The present invention is especially suitable for play balls which are not reinflated. Moreover, the present invention is also applicable to various other articles or laminates which contain pressurized gas therein such as rafts, for example, a life raft, balloons, inner tubes, tires, and the like.

While in accordance with the Patent Statutes, the best mode and preferred embodiment has been set forth, the scope of the invention is not limited thereto, but rather by the scope of the attached claims.

What is claimed is:

1. A tennis ball having improved rebound retention, comprising;

a pressurized hollow vulcanized rubber core having a barrier layer thereon, said barrier layer being the reaction product of a Lewis acid with said rubber core.

2. A tennis ball according to claim 1, wherein said Lewis acid comprises chlorine, fluorine, bromine, chlorosulfuric acid, or sulfur trioxide, combinations thereof, or a mixture of sulfur trioxide and sulfuric acid.

3. A tennis ball according to claim 2, wherein said Lewis acid comprises sulfur trioxide.

4. A tennis ball according to claim 3, wherein said barrier layer is located on the interior surface of said rubber core and wherein said sulfur trioxide is a gas.

5. A tennis ball according to claim 4, wherein said Lewis acid has been neutralized with an alkali metal or an alkaline earth metal, or with an ammonium salt or a quaternary ammonium salt, or combinations thereof, and wherein said core and barrier layer have a air permeability of from about 1.1 to about 5.0 barrers.

6. A tennis ball according to claim 4, wherein the tennis ball has at least a 53 percent rebound after five month's exposure to atmospheric pressure.

7. A low air permeable rubber laminate, comprising;

a cured pressurized hollow rubber substrate, and a low air permeable barrier layer, said barrier layer comprising a Lewis acid chemically bonded to said rubber substrate.

8. A low air permeable rubber laminate according to claim 7, wherein said Lewis acid comprises chlorine, fluorine, chlorosulfuric acid, or sulfur trioxide, combinations thereof, or a mixture of sulfur trioxide and sulfuric acid.

9. A low air permeable rubber laminate according to claim 8, wherein said Lewis acid comprises sulfur trioxide gas, and wherein said rubber natural or synthetic cis-1,4-polyisoprene.

10. A low air permeable rubber laminate according to claim 9, wherein said cured rubber substrate is a tennis ball, wherein said barrier layer is located on the inside of said ball, and wherein the air permeability of said ball is from about 1.1 to about 5.0 barrers.

11. In a process for making a low air permeable play ball comprising a hollow cured rubber core containing a gas under pressure;

the improvement comprising applying and reacting a Lewis acid to at least the inside of said core, or to the outside of said core, and forming a low air permeable barrier layer.

12. A process according to claim 11, wherein said Lewis acid is chlorine, fluorine, chlorosulfuric acid, or sulfur trioxide, combinations thereof, or a mixture of sulfur trioxide and sulfuric acid.

13. A process according to claim 12, wherein said Lewis acid comprises sulfur trioxide, and said process further including neutralizing said Applied Lewis acid.

14. A process according to claim 13, wherein said neutralizing agent is an alkali metal or an alkaline earth metal, or an ammonium salt or a quaternary ammonium compound, wherein said core and barrier layer have a air permeability of from about 0.95 to about 7 barrers, and including applying sulfur trioxide to only the inside of said core.

15. A process according to claim 14, including applying sulfur trioxide in the form of a gas.

* * * * *